United States Patent [19]

Fiedler

[11] 4,240,275

[45] Dec. 23, 1980

[54] EYELET BAR ARRANGEMENT FOR JACQUARD EQUIPPED WARP KNITTING MACHINES

[75] Inventor: Hans Fiedler, Obertshausen, Fed. Rep. of Germany

[73] Assignee: Karl Mayer Textilmaschinenfabrik GmbH, Obertshausen, Fed. Rep. of Germany

[21] Appl. No.: 14,813

[22] Filed: Feb. 26, 1979

[30] Foreign Application Priority Data

Mar. 4, 1978 [DE] Fed. Rep. of Germany ..... 2809391

[51] Int. Cl.[3] ..... D04B 23/00; D04B 27/00

[52] U.S. Cl. ..... 66/203

[58] Field of Search ..... 66/203, 213, 214, 209, 66/195

[56] References Cited

U.S. PATENT DOCUMENTS 3,834,193 9/1974 Wilkens ..... 66/195

*Primary Examiner*—Ronald Feldbaum

*Attorney, Agent, or Firm*—Omri M. Behr; Martin Sachs

[57] ABSTRACT

A jacquard equipped warp kniting machine is provided with means for maintaining a relatively constant tension on the dropper pin activator cords of the jacquard mechanism during the swing movement of the dropper bar. The means for providing a relatively constant tension includes a second eyelet bar which moves in a direction opposite to that of the dropper bar thereby equalizing the tension of the dropper pin activator cord.

5 Claims, 4 Drawing Figures

EYELET BAR ARRANGEMENT FOR JACQUARD EQUIPPED WARP KNITTING MACHINES

BACKGROUND OF THE INVENTION

1. Field of the Invention

The present invention relates to warp knitting machines and in particular to a warp knitting machine which includes a jacquard mechanism mounted thereon.

2. Description of the Prior Art

Warp knitting machines known in the prior art include a relatively large number of guide bars which are movable and utilize a stationary needle bar. Guide bars, in order to provide a wrap around the needles, are required to go through rather substantial swinging movements. In the type of machine where a jacquard mechanism is used to deflect one or more of the guide bars by the dropper pins associated therewith, a particular problem exists. In particular, when the jacquard bar and its associated dropper pin arrive at the extreme position at the end of a swing cycle, the tension is increased in the dropper pin cords which tends to act on the dropper pins and improperly activate them. Because of this improper activation it is necessary to utilize a comparatively small number of guide bars thereby reducing the number of pattern possibilities.

A similar problem arises when a warp knitting machine having twin needle beds and a jacquard arrangement associated therewith is utilized. Just as before, the guide bars move together in the swing (front to rear) direction. In this type of machine, in order to limit the movement of the guide bar, it is necessary to limit the pile height of the produced ware so that the movement of the bars is reduced thus, eliminating the unnecessary activation of the dropper pins. Unfortunately, this type of machine is unable to operate at high speeds, thereby reducing the amount of ware it produces for a given period of time.

SUMMARY OF THE INVENTION

The present invention overcomes the shortcomings found in the prior art by disclosing a means for operating a large number of guide bars and guide bars influenced by a jacquard mechanism in such a way as to avoid the undesired activation of the jacquard dropper pins. This is accomplished by providing a unique means for equalizing the tensions appearing in the dropper pin cords as the jacquard bar moves in the swing direction. By utilizing the principles set forth in the present invention it is possible to provide slack in the dropper pin cord in one position of the swing and release the slack as the jacquard bar moves through the other end of the swing, thereby maintaining a relatively constant tension on the dropper pin activation cords during the entire swing cycle.

In a jacquard equipped warp knitting machine having a guide bar with a plurality of guides affixed thereon, a first eyelet bar with a plurality of eyelets disposed therein affixed to the frame of the machine, a dropper pin bar affixed to the main suspension shaft of the machine, dropper pin activator pin cords operatively coupled, via the eyelets, between the dropper pin and the jacquard mechanism, the improvement, according to the principles of the present invention, comprises means for providing relatively constant tension on the dropper pin activator cords during the swing movement of the dropper bar.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
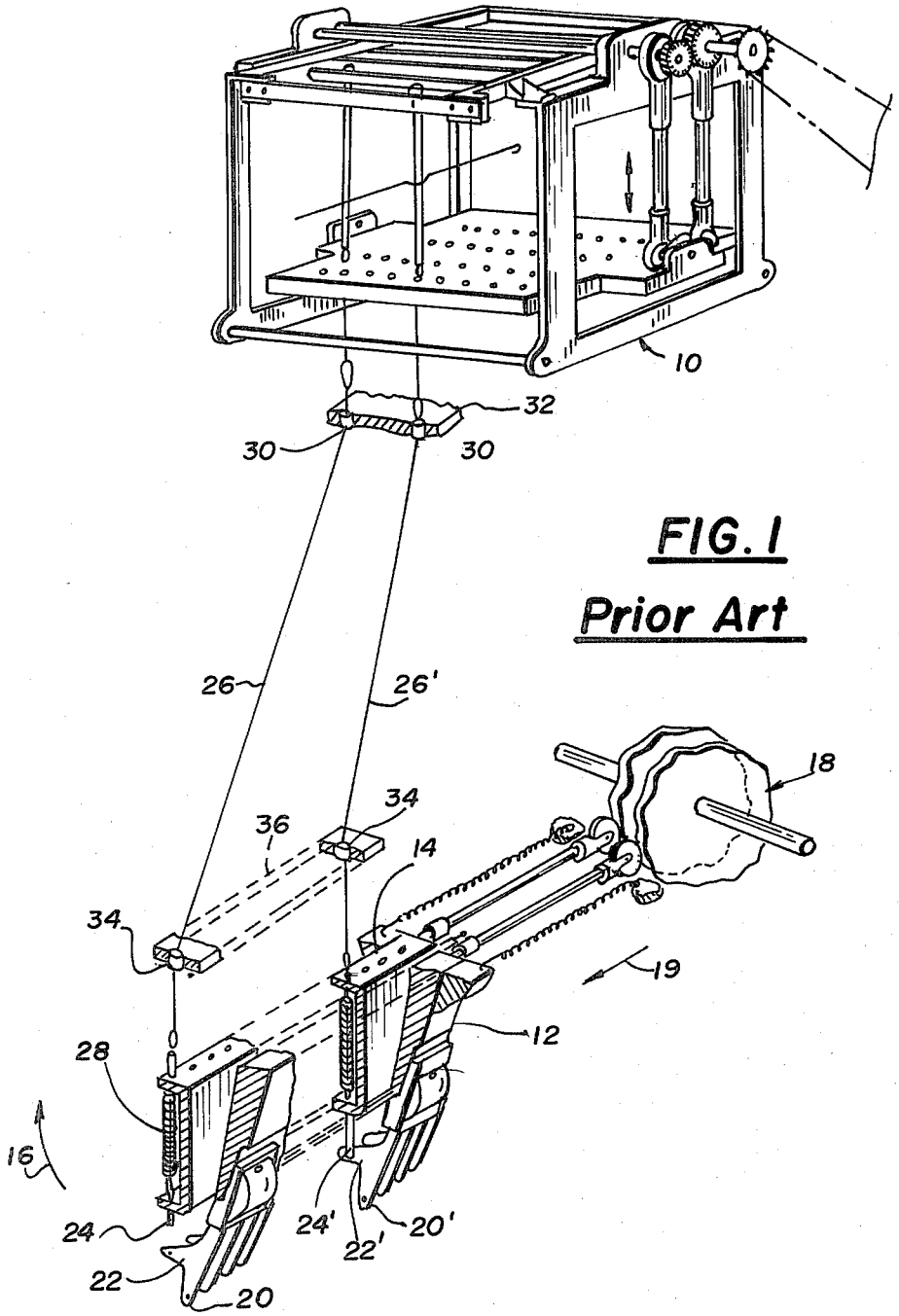
FIG. 1 Prior Art
FIG. 1 is a pictorial representation of a portion of a warp knitting machine, which utilizes a jacquard tip arrangement positioned proximate a guide bar of the machine.

Referring now to the figures, and in particular to FIG. 1, which discloses a jacquard mechanism 10 known in the prior art that is conventionally mounted in the frame of a warp knitting machine, not shown. Also included in the conventional warp knitting machine shown in FIG. 1, is a guide bar 12 partially broken away for clarity and a dropper pin bar 14 also broken apart for clarity, both of which are operatively coupled to a driving means, not shown, and are driven thereby in the direction of arrow 16, commonly referred to as the swing direction. Both the guide bar 12 and dropper pin bar 14 are also provided with a mechanism 18 that is operatively coupled to the warp knitting machine driving mechanism which enables the guide bar 12 and the dropper pin bar 14 to be moved in the displacement or lateral direction as shown by arrow 19. The guide bar 12 includes a plurality of guides 20 affixed thereon in a conventional manner. The guides 20 include extending portions 22 that are adapted to come into contact and cooperate with the dropper pins 24 which are slidably mounted and spring biased by means of spring 28 in dropper pin bar 14 in a conventional manner. As shown in FIG. 1, dropper pin 24' has been activated and permitted to extend into contact with the extending portion 22' of guide 20', thereby deflecting it as the guide 20' moves in the direction of arrow 16. Interaction between guide pins and guides are controlled by the programmable jacquard mechanism which is operatively connected to each of the dropper pins, on the opposite end thereof, by dropper pin cords 26 and 26', respectively.

The dropper pin cords are guided into position by means of a plurality of eyelets 30 provided in a guide bar 32 affixed to an extending portion of the frame 38 as well as the eyelets 34 provided in eyelet guide bar 36, all of which is conventional. The eyelet guide bar 36 serves to guide the dropper pin activator cords into position and may also be utilized to rotate the cords 26 and 26' in order insure that they appear directly over the dropper pins so that they may be readily affixed thereto, in a conventional manner.

Figure 2:
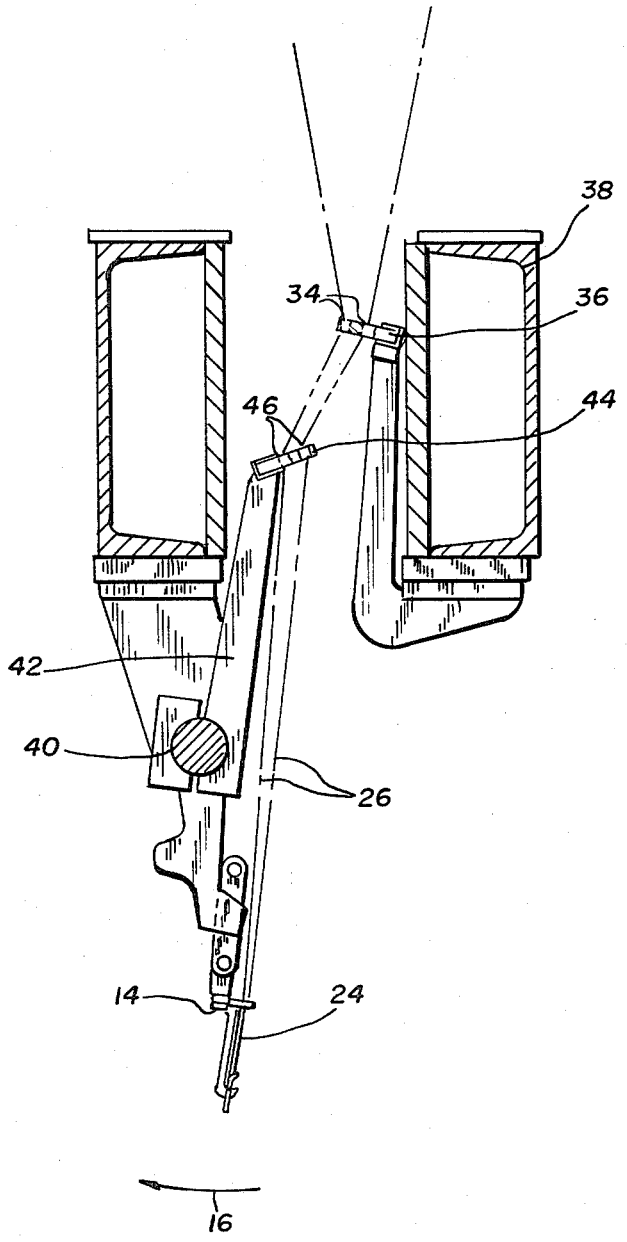
FIG. 2 is a cross-sectional view, in elevation, of a portion of a warp knitting machine in the region of the jacquard pin bar showing the eyelet bar orientation, according to the principles of the present invention, in its most forwardly position.

Referring now to FIG. 2 which discloses a cross-sectional view of a warp knitting machine having a frame 38 with a conventional eyelet bar 36 affixed thereto, in a conventional manner. The suspending shaft 40 has the droper pin bar 14 affixed thereon, as well as the guide bar which has been eliminated for clarity. The dropper pin bar is designed for movement in the displacement direction, which is in direction as shown by arrow 16. The dropper pin activator cords are affixed to the rear end of dropper pins 24 in a conventional manner and are drawn through the conventional eyelet bar 36 en route to the jacquard mechanism, as shown in FIG. 1. Additionally affixed to the shaft 40, by means of a lever 42, is an additional eyelet bar 44 which has a plurality of eyelets 46 provided therein through which the dropper pin activator cords 26 are threaded in their path to the jacquard mechanism.

FIG. 2 illustrates the forwardmost or one extreme position of the swing of the dropper pin bar 14. As can be readily seen from FIG. 2 the dropper pin activating cords 26 are bent severely as they are fed through the eyelets 34 of eyelet bar 36 and the eyelets 46 provided in eyelet bar 44.

Figure 3:
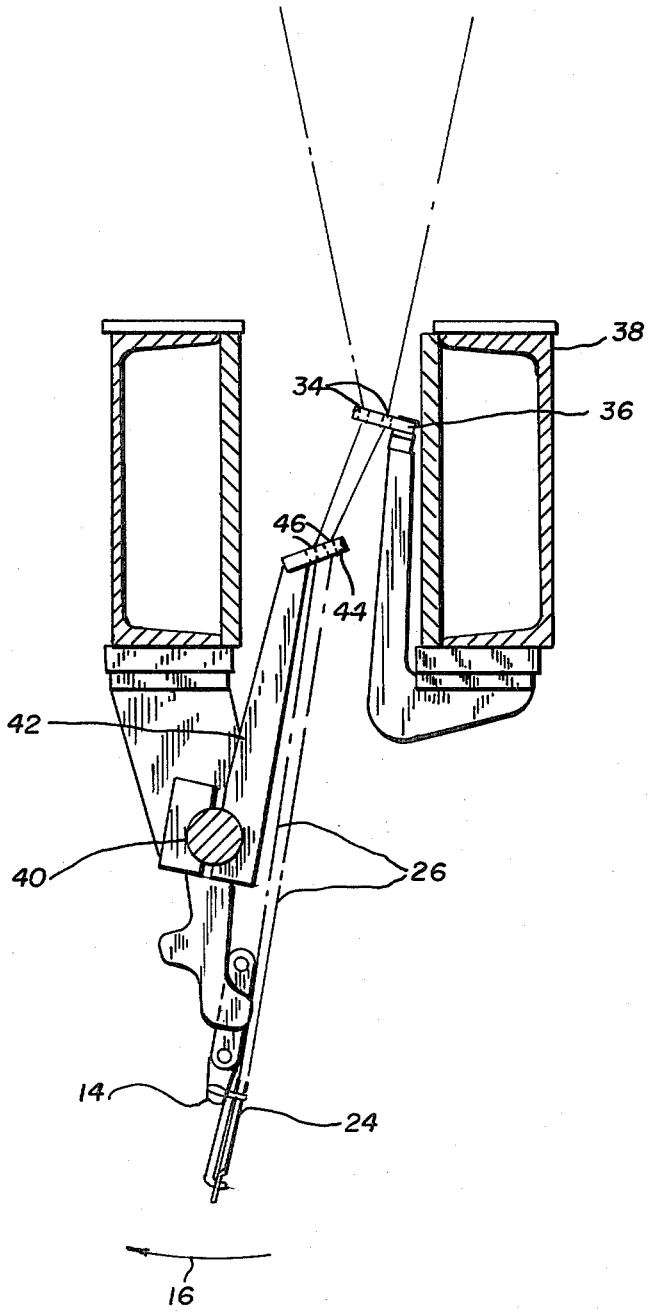
FIG. 3 shows the same arrangement as set forth in FIG. 2 with the guide bar in its middle position.

Referring now to FIG. 3 which shows the dropper pin bar 14 in its center or middle position. The dropper pin activating cords are not bent as severely as shown in FIG. 2 and the tension on the cords have remained essentially fixed by virtue of the fact that the lower portion of the dropper pin bar, by moving in the direction of arrow 16, would have required the dropper pin activating cords 26 to be placed under tension if the eyelet guide bar 44 had not been added to provide additional slack in the dropper pin cords when the guide bar 14 was in its forwardmost position.

Figure 4:
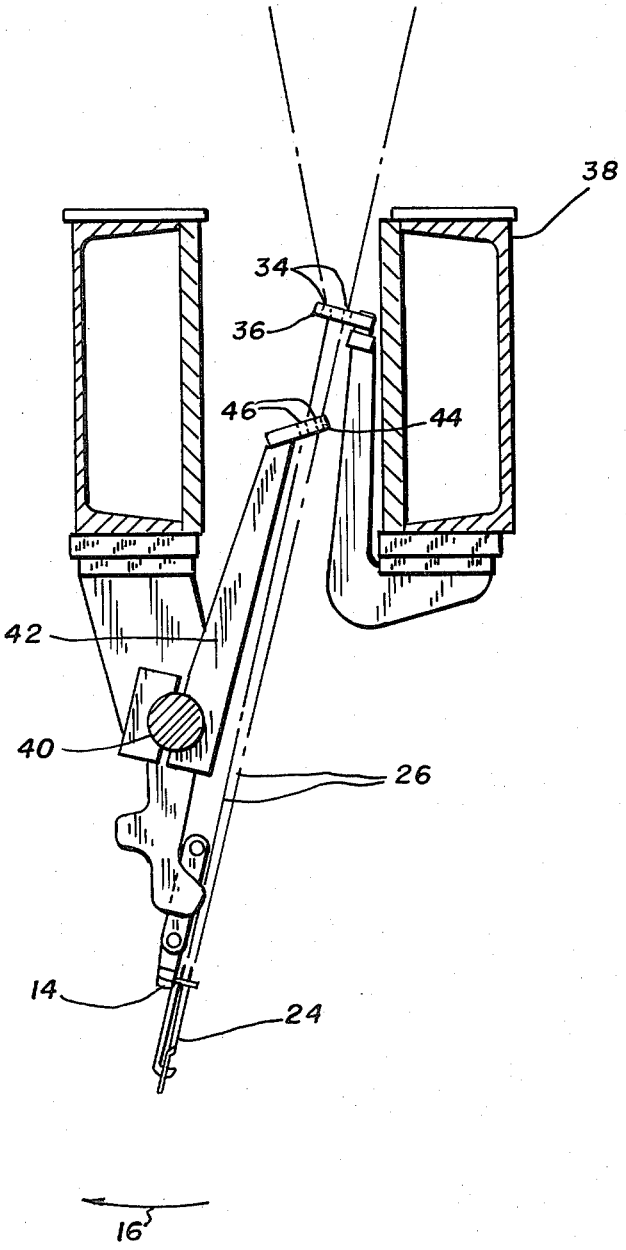
FIG. 4 shows the arrangement of FIG. 1 with the guide bar positioned in its most rearwardly position with the eyelet bars angularly disposed upwardly towards each other.

Referring now to FIG. 4 which discloses the guide bar 14 in its rearwardmost position. The dropper pin activation cords have been maintained with no change in tension thereon because the slack occasioned by movement from the forwardmost direction shown in FIG. 2 has been released by the direction of movement of the additional eyelet guide bar 44, thus, providing an essentially constant tension on the guide pin activating cords 26. Without the use of the additional eyelet guide bar 46 the dropper pin activating cords would have varying tension placed thereupon as the dropper pin guide bar is moved from its forwardmost to its rearwardmost position. This causes premature or erratic activation of the jacquard dropper pins 24 because the tension thereon varies during the weaving cycle.

It is also to be noted that the eyelet guide bars 36 and 44 are sloped upwardly towards each other in order to provide maximum cooperation therebetween and supply the additional slack in the dropper pin activating cords when the dropper pin guide bar 14 is in its forwardmost position.

Hereinbefore has been disclosed a means for providing a constant tension on the dropper pin activating cords even though the dropper pin bar is moved through a relatively large position in the swing direction and prevents the unwanted activation of the dropper pins by the jacquard mechanism. It will be understood that the various in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. In a jacquard equipped warp knitting machine having a guide bar with a plurality of guides affixed thereon, a first eyelet bar with a plurality of eyelets disposed therein affixed to the frame of said machine, a dropper pin bar affixed to the main suspension shaft of said machine, dropper pin activator cords operatively coupled, via said eyelets, between said dropper pin and said jacquard mechanism, the improvement comprising means for providing relatively constant tension on said dropper pin activator cords during the swing movement of said dropper bar.

2. A jacquard equipped warp knitting machine according to claim 1 wherein said means for providing relatively constant tension includes a second eyelet bar, said second eyelet bar being affixed to the means for providing movement relative to said first eyelet bar.

3. A jacquard equipped warp knitting machine according to claim 1 wherein said second eyelet bar is affixed to means for providing movement in a direction opposite to the movement of said dropper pin bar.

4. A jacquard equipped warp knitting machine according to claims 2 or 3 wherein said means for providing movement includes affixing said second eyelet bar to one end of a carrying lever, the other end of said carrying lever being affixed to and disposed above the suspending shaft of said guide bar.

5. A jacquard equipped warp knitting machine according to claim 1 wherein said first and second eyelet bars are sloped upwardly towards each other.

* * * * *